US006652432B2

(12) United States Patent
Smith

(10) Patent No.: US 6,652,432 B2
(45) Date of Patent: Nov. 25, 2003

(54) BALANCE THERAPY PLATFORM

(76) Inventor: Robert S. Smith, 1263 Emory St., San Jose, CA (US) 95126

( * ) Notice: Subject to any disclaimer, the term of this patent is extended or adjusted under 35 U.S.C. 154(b) by 181 days.

(21) Appl. No.: 10/021,655

(22) Filed: Dec. 12, 2001

(65) Prior Publication Data

US 2003/0109365 A1 Jun. 12, 2003

Related U.S. Application Data

(60) Provisional application No. 60/812,673, filed on Aug. 15, 2001.

(51) Int. Cl.[7] ..... A63B 22/14
(52) U.S. Cl. ..... 482/146
(58) Field of Search ..... 482/146–147, 482/77, 148, 34; 280/61; 472/106, 103, 95

(56) References Cited

U.S. PATENT DOCUMENTS 4,741,550 A * 5/1988 Dennis ..... 280/618
4,826,159 A * 5/1989 Hersey ..... 272/146
4,966,364 A * 10/1990 Eggenberger ..... 272/111
5,092,586 A * 3/1992 Tuthill et al. ..... 272/111
5,980,432 A * 11/1999 Ahman ..... 482/77
6,413,197 B2 * 7/2002 McKechnie et al. ..... 482/146

* cited by examiner

*Primary Examiner*—Nicholas D. Lucchesi
*Assistant Examiner*—L. Amerson
(74) *Attorney, Agent, or Firm*—Robert Samuels Smith

(57) ABSTRACT

An apparatus for performing exercises to improve balance including an exercise platform on one end of a helical spring supported on a base platform. In a preferred embodiment, a plurality of legs extend perpendicularly from the base platform which function as stops to preventing tilt of the exercise platform from exceeding a maximum tilt. The bottom end of each leg is mounted on a plate lying flush on the base platform that can be oriented so that the leg is positioned at a location corresponding to the required maximum tilt. A vertical rod is supported at a location spaced from the exercise plaform selected by the user depending on his exercise. Various devices such as a punching bag of tethered ball is attached to the vertical rod for incorporation into the users exercise regimen.

22 Claims, 3 Drawing Sheets

BALANCE THERAPY PLATFORM

CROSS REFERENCE TO RELATED APPLICATIONS

This application is a non-provisional application of provisional application No. 60/812,673 filed Aug. 15, 2001 from which priority is claimed.

FIELD OF THE INVENTION

This invention relates to platforms for supporting a user performing balancing exercises and particularly to a platform having means to adjust range of tilt of the platform.

BACKGROUND AND INFORMATION DISCLOSURE

The human body has three kinds of sense organs. One kind is the exteroceptors, which enable the body to become conscious of stimuli that originate outside the body—sight, sound, smell, and touch. A second kind are the enteroceptors, which enable a person to detect what, is going on inside his body such as swallowing food.

The proprioceptors are the organs in the body, which enable the body to maintain balance, develop motor skills, etc. The proprioceptors are located in skeletal muscle, tendons, blood vessels, and the gastrointestinal wall. A proprioceptor comprises an end of a sensory nerve wrapped around a muscle fiber and detects extension and contraction of the fiber. And transmits messages to the brain concerning position of the arms, legs, etc. in relation to their surroundings. Proprioceptors develop by training but, once trained, they function on a subconscious level. Proprioceptor training has been found to play an important role in strength increases associated with strength development programs. If a muscle is tested in an unaccustomed position, the strength of the muscle is diminished even though the muscular pull is carefully standardized. Proprioceptive training has been incorporated into a regimen of physical routines of complex motions called PNF technique, (proprioceptive neuromuscular facilitation.) Conventional methods of development can include rope skipping, horseback riding, and gymnastics.

PNF regimen is selected depending on the many purposes for which the routines are intended. These can include the early years of child development, conditioning for seniors of almost any age, athletes in intensive training in all sports and rehabilitation following an injury.

The PNF techniques that are applied by the prior art are generally of a non-quantitative nature compared to other training regimens such as weight lifting, sprinting, etc. There are some PNF exercises that can be evaluated quantitatively such as shooting a basketball, bowling, etc.

U.S. Pat. No. 5,092,586 discloses a disk exerciser for improving balancing skills being a disk supported on a threaded screw. The screw has a half round cap. The screw can be turned to increase/decrease the height of the level disk above the floor thereby controlling the difficulty of balancing on the disk. There is n means for measuring improvement;

The Reebok corporation distributes a balance exerciser (patent Pending) comprising a platform on a frame having four (rigidly mounted) legs. The disk is mounted on the frame by a means that permits the disk to tilt. The user actuates a lever to set three discrete settings for the "maximum tilt".—maximal, intermediate and minimal.

Consequently, the Reebok device does not permit continuous change of maximal tilt nor the range of maximum tilt that is contemplated for the present apparatus. This limitation and the limitation of maximum tilt at the highest maximum tilt are a severe limitation on the value of the device for progressive training compared to the present invention.

The prior art does not address the problem of measuring the difficulty of balance together with the controlling the difficulty of balance. MEASUREMENT OF PROGRESS RELATED TO CONTROL OF DIFFICULTY IS AN ESSENTIAL FEATURE OF ANY APPARATUS AND METHOD USED TO DEVELOP AN ATHLETIC SKILL.

SUMMARY OF THE INVENTION

It is an object of this invention to provide a device with which exercises can be performed involving development of strength and balance.

It is an additional object that the difficulty of performing the exercise can be controlled and that improvement in the athlete's ability to perform the exercise can be measured.

It is a further object that great many different exercises can be performed enabling the athlete to select those exercises that are directed toward his particular objectives. In this regard, an important feature of this invention is that the athlete can incorporate into his regimen, in combination with the apparatus, auxiliary devices such as tether balls, punching bags, dumbbells, bats, racquets, etc.

This invention is directed toward an exercise platform supported by a helical spring on a base platform. The athlete stands, sits or lies on the exercise platform and performs a routing of exercises selected according to his athletic objectives.

In general, the difficulty in performing the exercise is controlled by the "maximum tilt" that the exercise board can assume while performing the exercise. An important feature of this invention is the ability to select/change the maximum tilt as the ability of the athlete improves. This feature is provided by a plurality of vertical legs arranged around the central spring that are secured to the base platform and extend upward to stop the exercise platform from exceeding a maximum tilt. The maximum tilt is selected by selecting/changing the location of the legs relative to the spring.

For many exercises, the proficiency in performing the exercise is measured by a timer incorporated into the apparatus with which the user is enabled to measure improvements in his speed in performing the exercise. The timer measures the period between successive contacts of the exercise board with the leg. Alternatively, the timer measures the number of repetitions performed during a preset period.

In practice, the athlete sets the difficulty in performing the exercise by selecting the position of the leg. He measures his proficiency by measuring time. When his proficiency reaches a targeted level, he increases the difficulty by adjusting the position of the legs.

Another important feature of the device is a vertical pole that is positioned next to the exercise platform. The athlete hangs the device of his choice (a tethered football, soccer ball, tennis ball, a punching bag, etc.) on the pole and performs a related exercise—kicking, striking, dodging, catching. The distance of the pole from the exercise platform is adjustable and selected according to the athlete's activity. This arrangement provides a tremendous range of activities to the athlete and his ability to measure his progress.

BRIEF DESCRIPTION OF THE DRAWINGS

FIG. 10 shows a dumbbell with square plates for exercising in conjunction with the apparatus.

DESCRIPTION OF A BEST MODE

Figure 1:
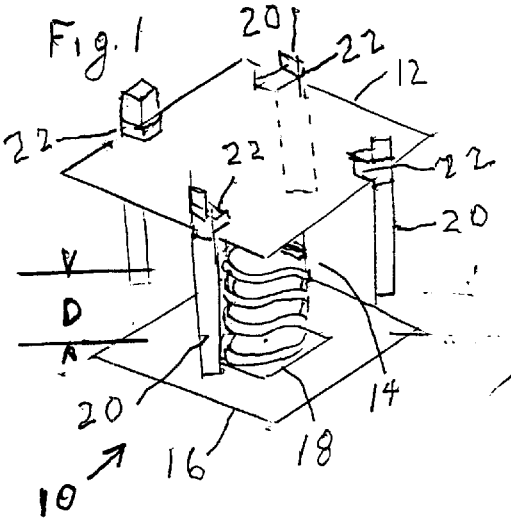
FIG. 1 shows the basic springboard of this invention.

Turning now to a discussion of the drawings, FIG. 1 shows the spring platform 10 of this invention including an exercise platform 12 supported by a vertical helical spring 14 on a base platform 16. The exercise platform is preferably about 36 inches diameter. The helical spring is preferably about 14 inches long, about five inches diameter and is made of spring wire about ⅝ inches diameter. The spring preferably has a compressive force constant of about 500 pounds per inch. A preferred design includes a pair of ½×9×9 inches steel plates 18, each plate 18 welded on an end of the spring 14 opposite a plate 18 on the other end of spring 14. The exercise platform 12 is centrally bolted to one plate 18 opposite the base platform 16 welded to the bottom plate 18.

To exercise with the device of FIG. 1, the user is supported on the exercise platform 12 and performs various movements. Exercises include shallow squats, deep squats, lunges, etc. sitouts, karote kicks. toe touching and any number of movements that shift the challenge the user to maintain balance.

FIG. 1 shows an embodiment where the range of maximum tilt can be selected according to the skill of the user and increased as the proprioceptive conditioning of the body improves. Four legs 20 are attached to the exercise platform 12 around the perimeter of exercise platform 12 and extending toward the base platform 16.

When the exercise platform 12 is horizontal, the lower end of the leg 20 is out of contact with the ground exercise platform by a distance, D. According to one embodiment, the distance D of each leg 20 is variable at the discretion of the user. Therefore the range of tilt can be selected to accommodate the skill level of the user. As the balancing skills of the user improves, he can shorten the distance D so that the maximum tilt is increased. The user can also increase the tilt in any one direction by appropriate individual selection of the distance D.

Figure 2:
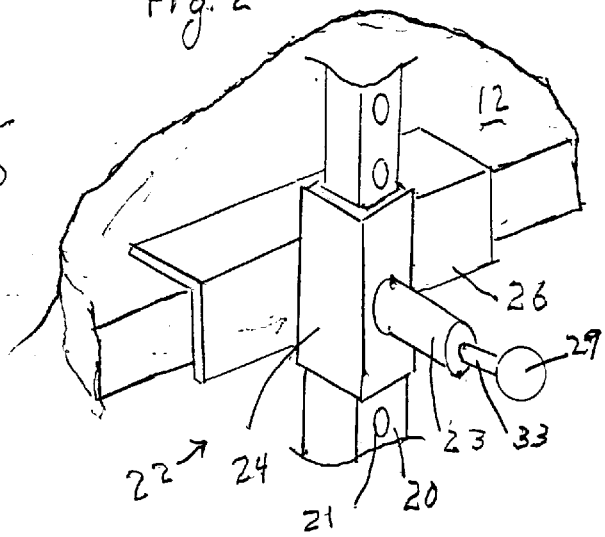
FIG. 2 shows the bracket for attaching the leg to the edge of exercise platform.

FIG. 2 shows to better advantage construction of a bracket 22 for attaching the leg 20 to the edge of the exercise platform 12. (The exercise platform 12 is shown cutaway and in FIG. 2) There is shown a length of rectangular tube 24 secured to an angle 26 that is bolted to the exercise platform 12. A spring-loaded pin ("popit"} 23 is shown that engages a selected one of the holes 21 in the side of the leg 20. The spring loaded pin (popit) 23 is disengaged from the hole 21 by pulling on knob 29.

Popits 23, well known and available on the market and are welded onto a surface of tube 24 with the extended end of the pin 33 protruding through a hole 21 in the tube 20.

Figure 3:
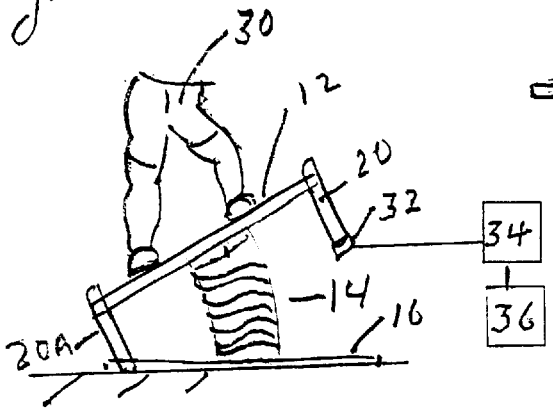
FIG. 3 shows a leg contacting the ground to close timing switch

FIG. 3 is a side view showing a user 30 on the exercise platform 12 tilted to where one leg 20 A is in contact with the base platform 16 thereby limiting the tilt of the exerciser platform 12. A switch 32 is mounted on the bottom end of leg 20A that closes every time the lower end of the leg 20A contacts the floor. The switch 32 is connected to a counter 34 that begins counting when activated by a timer 36. The switch is closed every time the leg 20 contacts the base platform 16.

In use, the user sets the timer 36 to activate the counter 34 for a preset period of time. The user performs an exercise in which the leg 20A repeatedly contacts the floor thereby repeatedly closing the switch 32 and registering a total number of counts during the preset period. The number of counts during the preset period is used to measure the improvement of the balancing skills of the user.

Numerous exercises can be performed using this feature as a means of measuring improvement of the proprioceptive condition of the user's musculature. Exercises include tilting the exercise platform 12 back and forth while turning in various directions and in the squat or erect position. Another exercise is to "walk around" or to rotate the body supported on the exercise platform.

To begin his program, the user first sets the length of the extended legs so that the maximum tilt of the exercise platform is minimal. He performs his exercise and notes his frequency of repetition in terms of the number of switch closings (tilts) per preset period. When his performance reaches a preselected value of frequency, he increases the range of tilt to the next level of difficulty.

Figure 4:
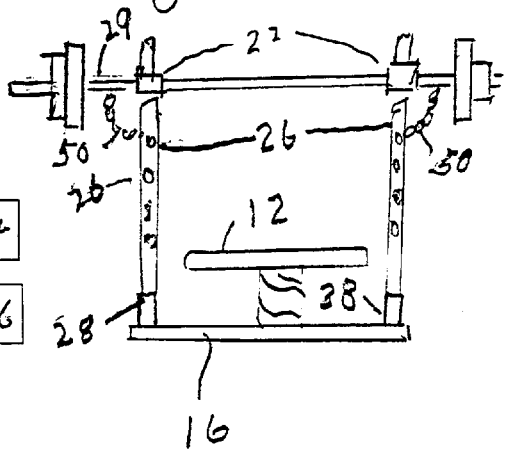
FIG. 4 shows apparatus poles supported on the base platform.

FIG. 4 shows another embodiment of the invention being one or two poles 26, whose lower end telescopes into a short section of tube 28 vertically mounted at the edge of the base platform 16. Two vertical poles 26 are shown in FIG. 4.

Vertical pole 26 serves a number of functions. It serves as a handhold for a user, particularly a user lacking balancing skill, to step up on the exercise platform.

Figure 8:
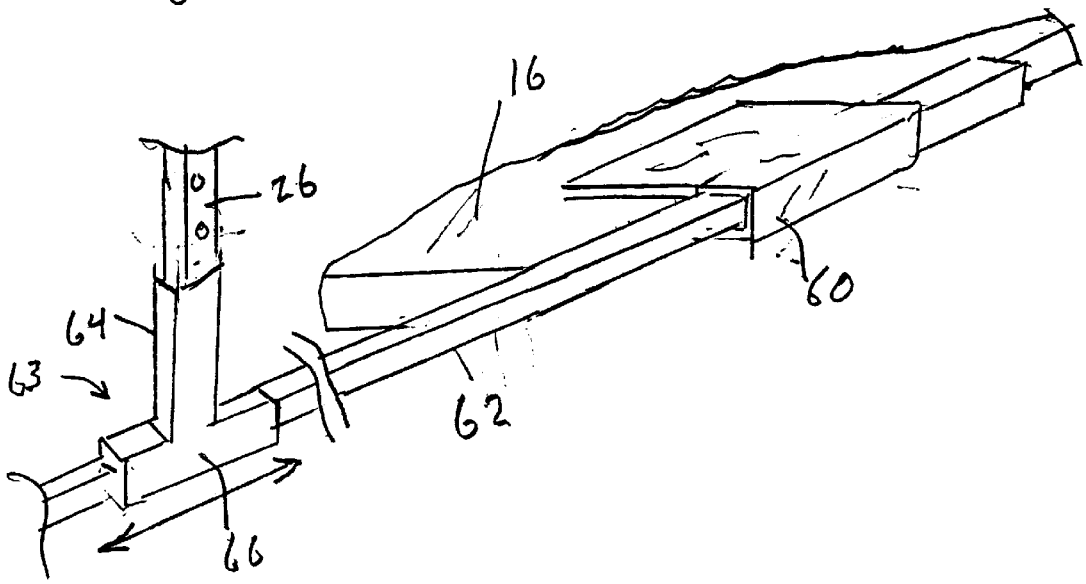
FIG. 8 shows an apparatus pole supported at a selectable distance from the exercise platform.

FIG. 8 shows details of a preferred embodiment for securing the vertical pole 26 to the edge of the base platform 16. There is shown a guide tube 60 secured parallel to an edge of base platform 16 (cutaway). A floor bar 62 telescopes through the guide tube 60. Tee support 63 is shown which includes a leg tube 64 having an end joined to the middle of a cap tube 66. Pole 26 has one end that telescopes into leg tube 64. Floor bar 62 telescopes into cap tube 66.

The vertical pole 26 has a linear vertical array of holes 21 that are engaged by the slider bracket 22 (shown in FIG. 2) that is slideably positioned on the vertical pole 28 and secured by popit 23. (FIG. 2) Various devices are attached to angle 26.

The arrangement for attaching the pole to the base platform 16 enables the user to position the pole 26 at a selected distance from the center of the exercise platform 12. For example, when the pole supports a punching bag, the pole will be close to the exercise platform. When the pole supports a tethered ball, the pole will be placed at a distance from the exercise platform 12.

Pole 21 may be either a square tube or a round bar.

Figure 5:
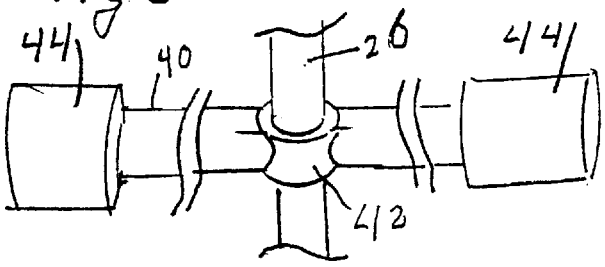
FIG. 5 shows an arm journalized onto the apparatus bar.

FIG. 5 shows one device being an arm 40 that is journalled at its middle by a bushing or bearing 42 to rotate around the vertical pole 26. A punching pad 44 is mounted on the end of each arm 40 providing that the user can balance him on the exercise platform and strike either one of the punching pads as it rotates on its axis.

FIG. 4 shows the pair of poles 26 with brackets 22 of FIG. 2 supporting a barbell 29 A pair of safety chains 50 are attached to the bar 29. The other ends of chains 50 are attached to a respective bracket 22. The user stands on the platform with the bar at shoulder height and supported on the brackets 22. He lifts the bar off the brackets 22 and performs any one of many exercises including squats, curls, military presses, rows, deadlifts, etc. In performing each exercise, the chain applies a limit to the lowest position of the bar. Thereby serving as a safety device for the user.

Devices which are attachable to pole 20 include a soccer ball basketball, etc is tethered by tether to one end of a cord and the other end of the cord is attached to bracket 22. at a selectable location on pole 26.

In using the tethered ball the spring board 10 is positioned next to a wall. The user stands on the platform and repeatedly throws or kicks the ball against the wall. While the user is throwing/catching the ball, he is also struggling to maintain balance. When he misses the ball, he is conveniently enabled to retrieve the ball by simply pulling on the tether, the end of which is always within easy reach being tied to the top end of the pole 2. The feature of the tethered ball makes the time spent doing the exercise of throwing/catching while balancing much more productive because the user does not have to spend time stepping off the platform to retrieve a missed ball.

Figure 6:
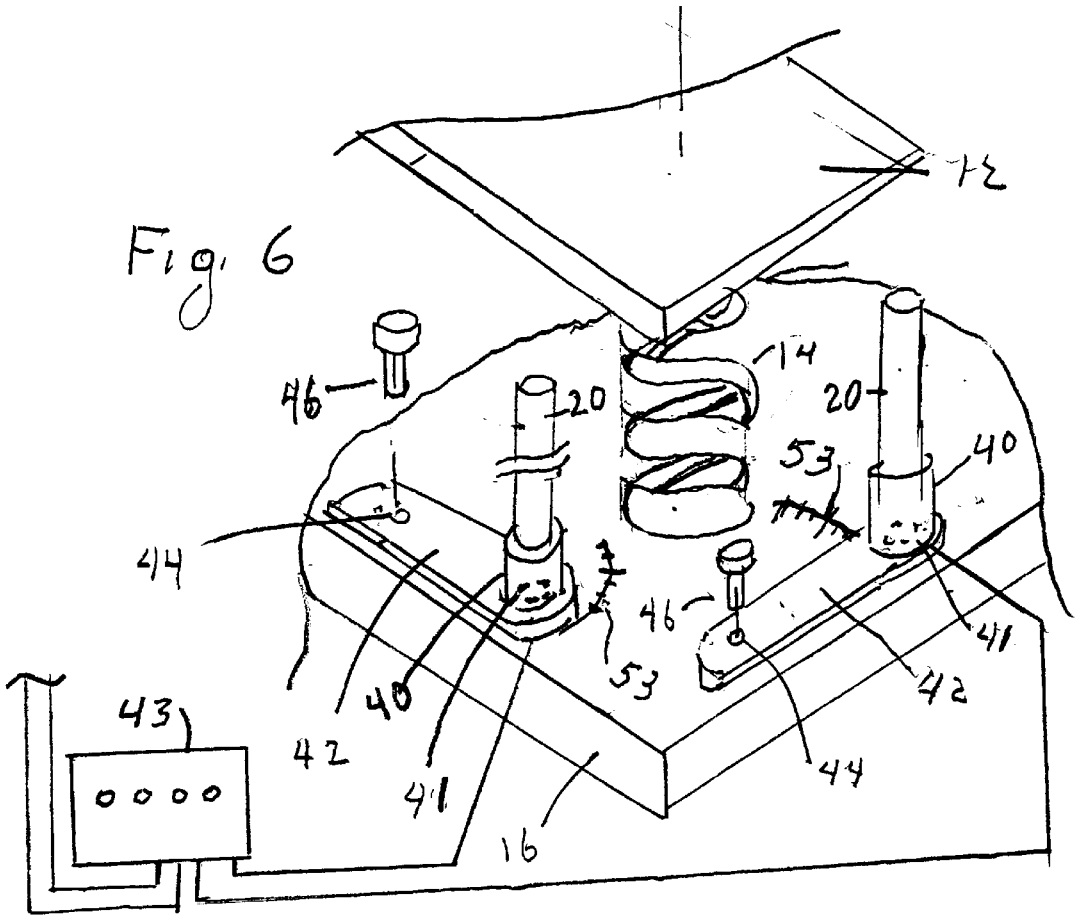
FIG. 6 shows leg support at a selectable location on the base platform.

FIG. 6 shows another arrangement for providing adjustable "maximum tilt" to the springboard. There is shown the exercise platform 12 supported by a vertical helical spring 14 on the base platform 16. Four vertical legs 20 are mounted on the base platform 16 arranged in quadrature around the helical spring 14. Only two legs 20 are shown in FIG. 6. The other two legs 20 are cut away together with a cutaway portion of ecercise platform 12 and base platform 16.

Details of the leg support 50 for each leg 20 are shown in FIG. 6. A short length of stub tube 40 is mounted on one end of a "tilt adjustment" plate 42. The stub tube 40 is preferably steel welded onto a steel plate 42. An aperture 44 is shown in an opposite end of the plate 42. The plate 42 is rotatably mounted flat on the base platform 16 by a pin (bolt) 46 that is positioned through the aperture 44 and a locating hole (not shown in FIG. 11 in the base platform 16 so that the stub tube 40 extends vertically from the plate 42 and base platform 16. A leg 20 telescopes into the open end of the stub tube 40. The length of the leg 20 is preferably about one to four inches shorter than the distance of the exercise platform 12 above the base platform 16. The top end of each leg 20 functions as a "stop" preventing the exercise platform 12 from tilting beyond a selected tilt angle (referred to herein as the "maximum tilt".).

The distance of the top end each leg 20 from the underside of the exercise platform 12 is variably selectable by simply rotating the plate 42 about the pin 46. Accordingly, when a relatively small amount of maximum tilt of the exercise platform 12 is required, each of the four plates 42 is rotated to where the top end of each leg 40 is close to the outside edge of the exercise platform 12. When a large maximum tilt is required, the plate 42 is rotated to where each leg 20 is closest to the center of the spring. Alternatively, each of the legs can be removed to obtain a maximum tilt. An important feature of the invention is that the maximum tilt of each leg is adjustable independent of the other legs. Another important characterisic is that very small changes of maximum tilt can be made by very small changes of the position of the plates.

An important feature for defining difficulty of balance is a scale 53 for each plate 42 that displays the maximum tilt corresponding to the orientation of the plate 42. The scale 53 is a valuable feature for an athlete who wants to "reset" his maximum tilt in order to maintain consistency between workouts and during his workout and to "fine tune" changes in difficulty of performing the exercise.

FIG. 6 shows another version of the invention according to which a switch 41 is positioned in the stub tube 40 under each leg 20. The switch is closed when the exercise platform contacts the respective leg. Each switch is connected to a signal light 43 or other signal recording device in console 45.

The combination of a switch 41 in each of the four stub tubes 41 and the ability to change change the maximum tilt in any direction by selectively positioning the tubes provides a very valuble tool for developing specialized and critical balancing skill.

For example, when a golfer drives a ball, he wants to shift his weight first back on his rear leg, as he draws back his club, and then to his forward leg as he follows through. He wants the plane defined by his feet and center of gravity to remain perpendicular.

The athlete or his coach is able to study the shift in his center of gravity by studying the light patterns displayed by console 43.

Figure 7:
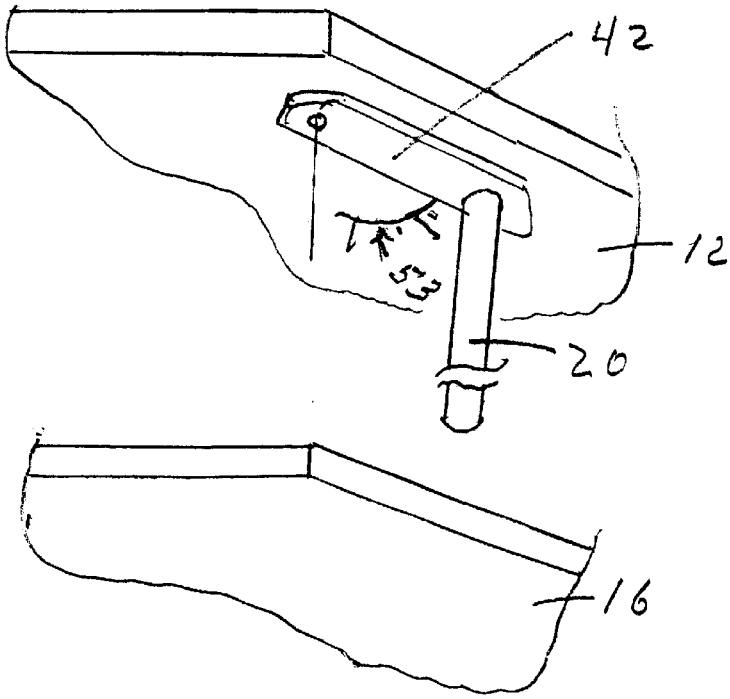
FIG. 7 shows a support plate on the bottom side of the exercise platform.

FIG. 7 shows another arrangement for selecting maximum tilt. The "tilt adjustment" plates are rotatably mounted onto the underside of the exercise platform 12. The exercise platform and base platform are cutaway in FIG. 7 and show only one leg, Each leg 20 is rigidly mounted to the respective plate 42 and therefore hangs down toward the base platform 16. The maximum tilt of exercise platform 12 relative to base platform 16 is determined by the position of the legs 20 on the base platform 16 and is selected by appropriate orientation of the tilt adjustment plate 42 on the underside of exercise platform 12.

An advantage of the version of FIG. 6 compared to FIG. 7 is that, in the former case, the legs are removable and replaceable.

An important advantage of the adjustable maximum tilt is that the maximum tilt can be selected according to the skills of the user or according to his selection of exercise performed on the exercise platform. An important feature of the invention is that the maximum tilt can be changed continuously (by very small increments) rather than in large incremental changes. Another important distinction is that the orientation of each plate is independent of the orientation of the other plates providing that exercises can be performed in which maximum tilt depends on direction of tilt. Thereby introducing another parameter into the exercise regimen.

Various selected devices are mountable near the upper end of the apparatus tube. The device is selected according to the interest of the user and can include a punching bag, a tetherball, etc. The device is mounted on the apparatus tube at a selectable height from the floor.

Figure 9:
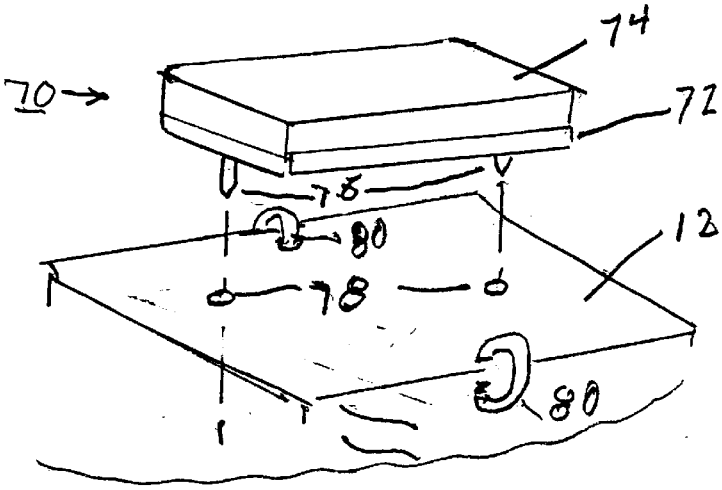
FIG. 9 shows a removable pad for performing prone exercises.

FIG. 9 shows another embodiment of the invention in which a removable pad 70 is detachably mounted on the exercise platform. The pad is preferably a flat board 72 having upholstery 74 covering one side. A pair of prongs 76 extends from the board opposite the upholstery. A pair of apertures 78 are formed in the exercise platform located to enable laying the pad 70 on the exercise platform 16 and secured from sliding by the prongs 76 engaging the apertures 78. This feature enables the user to lie comfortably on the pad mounted on the exercise platform and perform a large variety of exercises including leg raises, etc.

FIG. 9 shows removable handles 80 that are attachable at selected locations around the perimeter of the board.

Exercises with the handles include leg lifts where the user, grasps a handle in each hand with one foot on an opposite edge and lifts his other leg.

In another exercise performed with the handles 80 and the pad 70, the user lies with back on the pad 70, grasps a handle in each hand, and rolls/swings his legs laterally or over his head.

Many exercises can be performed lying or standing on the exercise program while lifting dumb-bells. FIG. 10 shows dumb-bells which are preferred for performing exercises while standing or lying on the platform. The dumb-bell has removable square plates 85 mounted on a handle 87. The square shape of the dumbbell plates 85 provides that the user can lay the dumb-bells on the exercise platform while he mounts/dismounts from the platform. Mounting onto and dismounting from the exercise platform while holding a pair of dumb-bells is very challenging and really limits the weight of the dumb-bell that a user can use on the exercise platform.

According to the method of this invention involving the use of dumbbells while supported on the exercise platform, the user is enabled to lay the square dumb-bells on the exercise platform before he mounts onto the platform. He then mounts onto the exercise platform without the dumb-bells rolling off the exercise platform. He can then pick up the dumbbells to continue his program.

Features of the spring board of this invention present a very versatile apparatus for balance exercises in terms of the selection of in maximum angle of tilt, measuring reaction time, variety of sports related devices used in combination with the apparatus, exercises performed lying, sitting or standing. Variations and modifications of the device may be contemplated after reading the specification and studying the drawings that are within the scope of the invention.

For example, while the tubes shown in the drawings have a square cross section, it would be obvious to one skilled in the art that the scope of the invention includes tubes having a circular cross section.

The scope of the claims are further defined by the terms "maximum tilt" and "stop means for establishing maximum tilt wherein said maximum tilt is continuously selectable and has a value depending on the direction of tilt". The feature, continuously selectable maximum tilt, is inherent in the arrangement of plate 42 which permits orienting plate 42 in any orientation between where the leg 20 is adjacent edge of the exercise platform and where the leg is adjacent the spring. The feature in the claims is inherent in the arrangement whereby legs 20 of different lengths can be substituted.

I therefore wish to define the scope of my invention by the appended claims.

I claim:

1. An apparatus for performing any one of a group of exercises to improve balance of a user, said apparatus comprising:

a base platform;

an exercise platform;

a spring having one end mounted in about a center location of said base platform and extending perpendicularly away from said base platform;

said spring having another end opposite said one end and said exercise platform supported on said opposite end in about a cednter location of said exercise platform operably arranged to provide that said exercise platform is parallel to said base platform whereby a user is enabled to place said base platform on a ground surface, mount onto a top surface of said exercise board and perfom any one of said group of exercises a stop means for limiting tilt of said exercise platform to a maximum tilt of said exercise platform relative to said base platform wherein said maximum tilt is continuously selectable and has a value depending on the direction of tilt; said stop means including a plurality of legs, each said leg being shorter than a distance between said exercise platform and said base platform; means for securing an end of each said leg to one of: (i) a surface of said exercise platform facing said base platform and arranged to enable said user to position said leg at any distance between said spring and an edge of said exercise platform; (ii) a surface of said base platform facing said exercise platform and arranged to enable said user to position said leg at any distance between said spring and an edge of said exercise platform.

2. The apparatus of claim 1 comprising timing means for timing a repetition period between successive contacts of said exercise platform with said stop means.

3. The apparatus of claim 2 wherein said timing means comprises:

a clock coupled to a switch;

said switch arranged to close when said exercise board contacts said switch.

4. The apparatus of claim 3 wherein said switch is located on said stop means.

5. The apparatus of claim 1 wherein said stop means comprises:

means for, mounting at least one leg on an edge of and perpendicular to a surface of said exercise platform facing said base platform and arranged to provide that when said exercise platform is tilted sufficiently toward any one of said at least one leg, said end of said any one leg contacts said base platform thereby restraining said platform from further tilt.

6. The apparatus of claim 5 wherein said means for mounting arranged for engaging said at least one leg at a selectable location on said at least one leg comprises:

said leg having a linear array of apertures along said leg;

a tube selected to telescope onto said leg;

a spring loaded popit arranged to engage any selected aperture of said linear array of apertures.

7. The apparatus of claim 1 wherein said stop means comprises said at least one leg mounted on one end perpendicularly on a surface of said exercise platform facing said base platform and arranged to provide that when said exercise platform is tilted sufficiently toward said any one of said at least one leg, another end of said leg contacts said base platform at a location thereby restraining said platform from further tilt.

8. The apparatus of claim 7 wherein said stop means is arranged to provide that said location where said leg contacts said base platform is selectable.

9. The apparatus of claim 8 comprising:

at least one plate, one said plate for each one of said at least one leg;

each said at least one plate having a length between one end and another end of said plate;

means for mounting said one end of said any leg perpendicularly onto said one end of said plate respectively;

each one of said at least one plate having an aperture at said another end;

each one of said at least one plate rotatably mounted on a surface of said base platform facing said exercise platform; said at least one plate rotatably mounted by a pin through said aperture and a pin location in said exercise platform whereby a location of contact of said another end of said any leg with said base platform is selectable by selecting orientation of said plate about said pin location;

said at least one pin location for each plate operably distributed on said base platform to limit maximal tilt of said exercise platform in any direction corresponding to pin location and orientation of each said at least one plate.

10. The apparatus of claim 1 wherein said stop means comprises at least one leg mounted on one end perpendicularly at a selected location on said base platform and arranged to provide that said exercise platform tilted sufficiently toward another end of said leg contacts said any one leg at a location thereby restraining said platform from further tilt.

11. The apparatus of claim 10 wherein said adjustable stop means is arranged to provide that said location of said contact is selectable whereby a user is enabled to select said maximum tilt.

12. The apparatus of claim 11 wherein said adjustable stop means comprises:

at least one plate, one said plate for each one of said at least one leg;

each said at least one plate having a length between one end and another end of said plate;

means for mounting said one end of said any leg perpendicularly onto said one end of said plate respectively;

each one of said at least one plate having an aperture at said another end;

each one of said at least one plate rotatably mounted on a surface of said base platform facing said exercise platform by a pin through said aperture and a pin location in said base platform whereby a location of contact of said another end of said any leg with said exercise board is selectable by selecting orientation of said plate about said pin location providing that maximum tilt is selectable;

said at least one pin location for each plate operably distributed on said base platform to limit maximal tilt of said exercise platform in any direction corresponding to pin location and orientation of each said at least one plate.

13. The apparatus of claim 12 comprising indicia on said surface of said base platform representing selected maximum tilt in a direction of said respective leg.

14. The apparatus of claim 12 wherein said means for mounting said one end of said any leg perpendicularly onto said one end of said plate comprises:

a stub tube vertically mounted on said plate at said one end;

said stub tube having a size selected to telescope with said any leg providing that the leg can be separated from the apparatus when the user desires.

15. The apparatus of claim 14 comprising:

at least one switch, one switch of said at least one switch positioned in said stub tube, one said switch for one said stub tube, each switch positioned to close when said exercise platform contacts said each switch;

an array of signal lights, one signal light for each switch, connected to light when said exercise board contacts said respective leg.

16. The apparatus of claim 1 comprising:

a pole;

a pole means adapted for supporting any one device of a group of devices at a location on said pole;

means for mounting one end of said pole on said base platform with said pole extending perpendicularly away from a plane of said base platform providing that a user is enabled to be supported on said exercise platform and include use of said any one device in performing said exercises.

17. The apparatus of claim 16 wherein said means for mounting one end of said pole comprises:

a base mounting tube, having a square cross section, secured parallel to a surface of said base platform;

an elongated member having a cross section dimensioned to permit one end of said elongated member to telescope into said mounting tube;

a tee member comprising one stub tube joined perpendicularly to another stub tube;

said one stub tube telescoping onto said elongated member and said another stub tube telescoping onto said pole, oriented perpendicular to said base platform and said exercise platform, enables a user to position said pole at a selected distance from a center of said exercise platform, hang a selected exercise device on said pole, stand on said exercise platform and perform exercises involving said exercise device.

18. The apparatus of claim 17 wherein said base platform is square and said mounting tube is secured to said base platform along an edge of said base platform.

19. The apparatus of claim 1 further comprising at least one combination clamp and handle arranged to enable a user to detachably secure said clamp to an edge of said exercise platform and grasp said clamp while being supported on said exercise platform and perform exercises.

20. The apparatus of claim 1 further comprising:

at least two apertures through said exercise platform;

a board having padding on one side and at least two prongs extending from a side of said board opposite said padding and arranged to detachably engage said at least two apertures when said board is laid on a surface of said exercise platform and permit a user to lie on said padding and perform exercises.

21. The apparatus of claim 1 further comprising:

at least one combination clamp and handle arranged to enable a user to detachably secure said at least one clamp to an edge of said exercise platform;

at least two apertures through said exercise platform;

a board having padding on one side and at least two prongs extending from a side of said board opposite said padding, one prong for each aperture, and arranged to detachably engage said at least two apertures when said board is laid on a surface of said exercise platform and permit a user to lie on said padding and perform exercises.

22. An apparatus for performing any one of a group of exercises to improve balance of a user, said apparatus comprising:

a square base platform;

an exercise platform;

a spring having one end mounted in about a center location of said base platform ad extending perpendicularly away from said base platform;

said spring having another end opposite said one end and said exercise platform supported on said opposite end in about a center location of said exercise platform operably arranged to provide that said exercise platform is parallel to said base platform whereby a user is enabled to place said base platform on a ground surface, mount onto a top surface of said exercise board and perform any one of said group of exercises;

at least one leg, each one of said each one leg having a length that is less than a distance between said exercise platform and said base platform;

at least one plate, one said plate for each one of said at least one leg;

each said at least one plate having a length between one end and another end of said plate;

each one of said at least one plate having an aperture at said another end;

each one of said at least one plate rotatably mounted on a surface of said base platform facing said exercise platform by a pin through said aperture and a pin location in said base platform a stub tube vertically mounted on said plate at said one end;

said stub tube having a size selected to telescope with said any leg providing that the leg can be separated from the apparatus when the user desires whereby a location of contact of said another end of said any leg with said exercise board is selectable by selecting orientation of said plate about said pin location providing that maximum tilt is selectable;

said at least one pin location for each plate operably distributed on said base platform to limit maximal tilt of said exercise platform in any direction corresponding to pin location and orientation of each said at least one plate;

a pole adapted for supporting any one device of a group of devices at a location on said pole;

a base mounting tube, having a square cross section, secured parallel to and along an edge of said base platform;

an elongated member having a cross section dimensioned to permit one end of said elongated member to telescope into said mounting tube;

a tee member comprising one stub tube joined perpendicularly to another stub tube;

said one stub tube telescoping onto said elongated member and said another stub tube telescoping onto said pole, oriented perpendicular to said base platform and said exercise platform, said pole having a row of apertures along said pole;

a device support slidably positionable along said pole and having a popit for detachably securing said support at a selected aperture on said pole whereby a user is enabled to position said pole at a selected distance from a center of said exercise platform, hang a selected exercise device on said pole, stand on said exercise platform and perform exercises involving said exercise device;

a pair of dumbbells having removable square plates whereby said pair of dumbbells placed on said exercise platform remain positioned on said exercise platform until removed by said user;

at least one combination clamp and handle arranged to enable a user to detachably secure said clamp to an edge of said exercise platform and grasp said clamp while being supported on said exercise platform and perform exercises;

at least two apertures through said exercise platform;

a board having padding on one side and at least two prongs extending from a side of said board opposite said padding and arranged to detachably engage said at least two apertures when said board is laid on a surface of said exercise platform and permit a user to lie on said padding and perform exercises.

* * * * *